US007410346B2

(12) United States Patent
Niwata

(10) Patent No.: US 7,410,346 B2
(45) Date of Patent: Aug. 12, 2008

(54) OIL PUMP

(75) Inventor: Dai Niwata, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 644 days.

(21) Appl. No.: 10/974,843

(22) Filed: Oct. 28, 2004

(65) Prior Publication Data

US 2005/0095148 A1 May 5, 2005

(30) Foreign Application Priority Data

Nov. 4, 2003 (JP) ..... 2003-374151

(51) Int. Cl.
*F04B 49/00* (2006.01)
*F04B 17/00* (2006.01)

(52) U.S. Cl. ..... 417/310; 417/410.4

(58) Field of Classification Search ..... 417/310, 417/540, 440; 418/166, 171
See application file for complete search history.

(56) References Cited

U.S. PATENT DOCUMENTS 5,013,220 A * 5/1991 Nakagawa et al. ..... 417/310

FOREIGN PATENT DOCUMENTS

JP 2003-184523 * 7/2003
JP 2003-184523 A 7/2003

* cited by examiner

*Primary Examiner*—Dmitry Suhol
*Assistant Examiner*—Alexander B. Comley
(74) *Attorney, Agent, or Firm*—Foley & Lardner LLP

(57) ABSTRACT

An oil pump includes a partition for dividing an outlet port into a first passage section on the upstream side and a second passage section on the downstream side, wherein a discharge passage fluidly communicates with the first passage section, and a relief valve is disposed in the second passage section.

19 Claims, 6 Drawing Sheets

OIL PUMP

BACKGROUND OF THE INVENTION

The present invention relates to an oil pump for feeding lubricating oil to various slide portions of an internal combustion engine, for example.

A trochoid oil pump for an automotive internal combustion engine comprises a pump casing formed with inlet and outlet ports formed in both sides, and a drive shaft arranged through the pump casing roughly in the center for receiving torque of an engine crankshaft. Arranged rotatably in the pump casing are an inner rotor coupled to the drive shaft and including external teeth at the outer periphery, and an outer rotor including internal teeth meshed with the external teeth of the inner rotor.

With rotation of the inner and outer rotors, volume chambers defined between the internal and external teeth of the rotors vary in volume to discharge to the outlet port lubricating oil inhaled through the inlet port, ensuring pump action. Excess oil discharged through the outlet port is returned from a relief valve to the low-pressure side (inlet-port side), achieving the discharge pressure controlled at a given value.

With the oil pump, however, since lubricating oil inhaled through the inlet port is discharged to the outlet port while being compressed due to volume variation in the volume chambers as described above, pulsation at a certain period occurs to cause sideward oscillation of the relief valve, opening/closing a relief port. This can amplify pulsation to produce relatively great noise at the discharge side.

With the aim of reducing pulsation, Japanese document P2003-184523A teaches an oil pump which comprises a bent wall arranged downstream of the outlet port and a branch passage arranged downstream of the bent wall to reverse the direction of oil flow, whereby oil out of the outlet port is made to flow from the bent wall to the branch passage.

SUMMARY OF THE INVENTION

With the oil pump disclosed in the above Japanese document, since pulsation is reduced by making oil which flows straight in the discharge passage interfere with the wall surface of the bent wall for reducing kinetic energy of oil only, the relief valve can undergo more or less pulsation to cause amplified pulsation, resulting in no achievement of sufficient reduction in pulsation.

It is, therefore, an object of the present invention to provide an oil pump which allows sufficient reduction in pulsation with simple structure.

The present invention provides generally an oil pump which comprises: a plurality of volume chambers each having a volume varied to inhale and discharge oil; inlet and outlet ports, the inlet port being arranged to open over the volume chambers having the increasing volume, the outlet port being arranged to open over the volume chambers having the decreasing volume; a relief valve which operates when a pressure of oil discharged to the outlet port exceeds a predetermined value, relieving part of oil in the outlet port; a partition which divides the outlet port into upstream and downstream sections; and a discharge passage which fluidly communicates with the upstream section of the outlet port, wherein the relief valve is disposed in the downstream section of the outlet port.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
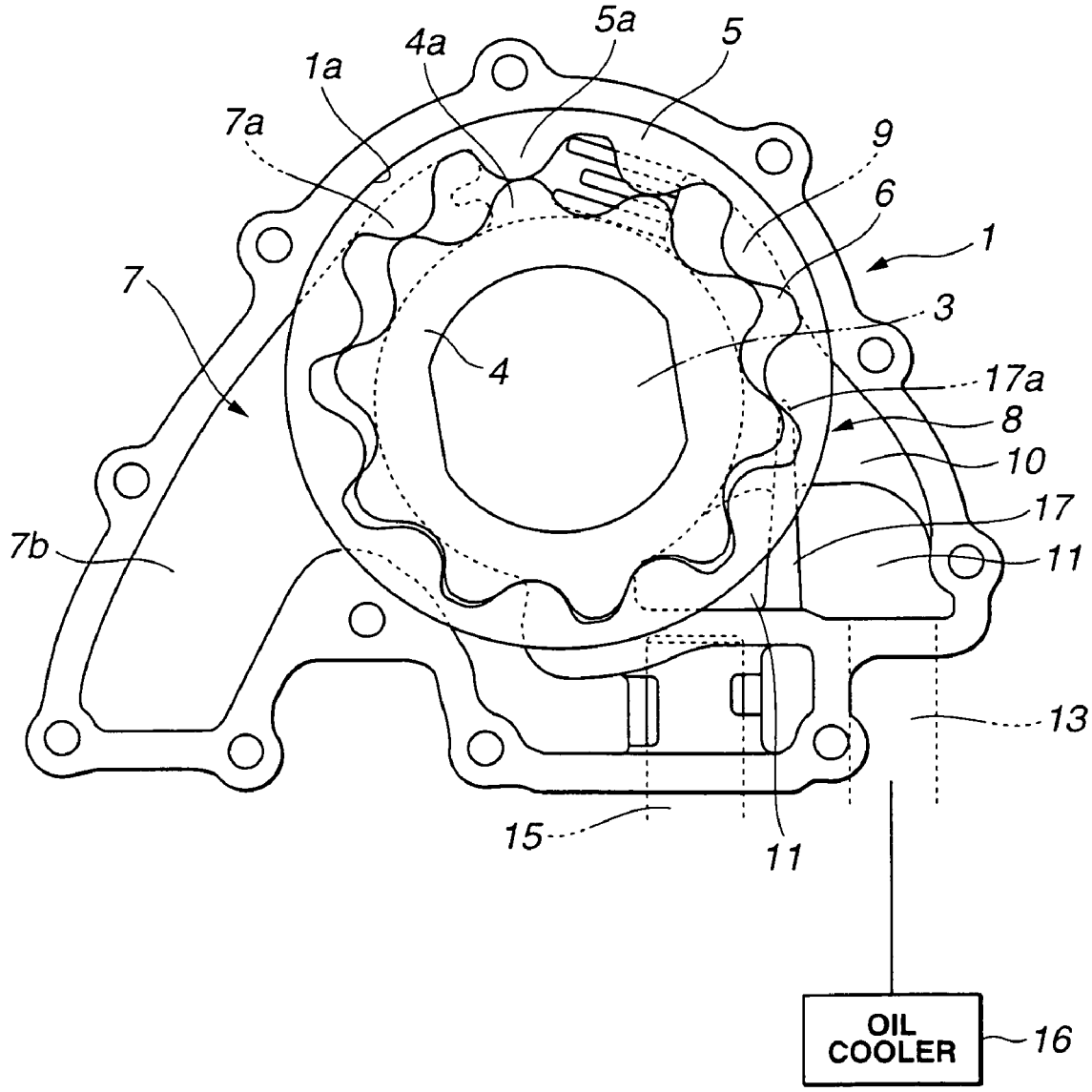
FIG. 1 is a front view showing an embodiment of an oil pump, with a pump cover removed, according to the present invention.

Referring to the drawings, a description will be made about a preferred embodiment of an oil pump according to the present invention. In the illustrative embodiment, the present invention is applied to a trochoid oil pump for an automotive internal combustion engine.

Referring to FIGS. 1-5, the oil pump comprises a pump casing 1 integrated with a cylinder block at a front end and having an open end closed by a pump cover 2, a drive shaft 3 arranged through pump casing 1 roughly in the center for receiving torque of an engine crankshaft, and inner and outer rotors 4, 5 rotatably accommodated in a circular pump chamber 1*a* of pump casing 1. Inner rotor 4 is coupled to drive shaft 3, and has ten external teeth 4*a* formed at the outer periphery.

Outer rotor 5 has a center offset from center of inner rotor 4 by a predetermined amount, and an inner periphery formed with eleven internal teeth 5*a* meshed with external teeth 4*a*. Therefore, volume chambers 6 each corresponding to one external tooth 4*a* are defined between rotors 4, 5, the volume of which varies with rotation of rotors 4, 5.

Referring to FIG. 1, pump casing 1 has an inlet port 7 formed in the left side and an outlet port 8 formed in the right side. Inlet port 7 comprises a roughly arcuate inlet chamber 7*a* arranged to face pump chamber 1*a* and open into volume chamber 6 and an inlet-port section 7*b* for introducing oil within an oil pan to inlet chamber 7*a*.

Outlet port 8 comprises a roughly arcuate outlet chamber 9 arranged to face pump chamber 1*a* and open into volume chamber 6 and an outlet-port section 10 for discharging oil within outlet chamber 9.

Referring to FIGS. 1, 2, and 6-8, outlet-port section 10 is formed to expand in diameter from the upstream side or the side of outlet chamber to the downstream side, and has a bend 11 provided at a downstream end.

Bend 11 is curved from the main bottom face of outlet-port section 10 at a substantially 90° angle to present the shape of roughly like a letter L. That is, bend 11 is formed concavely along the axial direction of dive shaft 3. Thus, the entire structure including a discharge passage 13 and a relief valve 15 is curvedly formed roughly like a crank. Bend 11 has a downstream end which fluidly communicates with discharge passage 13 arranged in a pipe 12 vertically integrated with a lower end of pump casing 1, and with relief valve 15 arranged in a cylindrical valve body 14 vertically formed roughly parallel to the side of pipe 12. Pipe 12 and valve body 14 are disposed adjacent to each other. The downstream side of discharge passage 13 fluidly communicates with an oil cooler 16 as an instrument.

Figure 7:
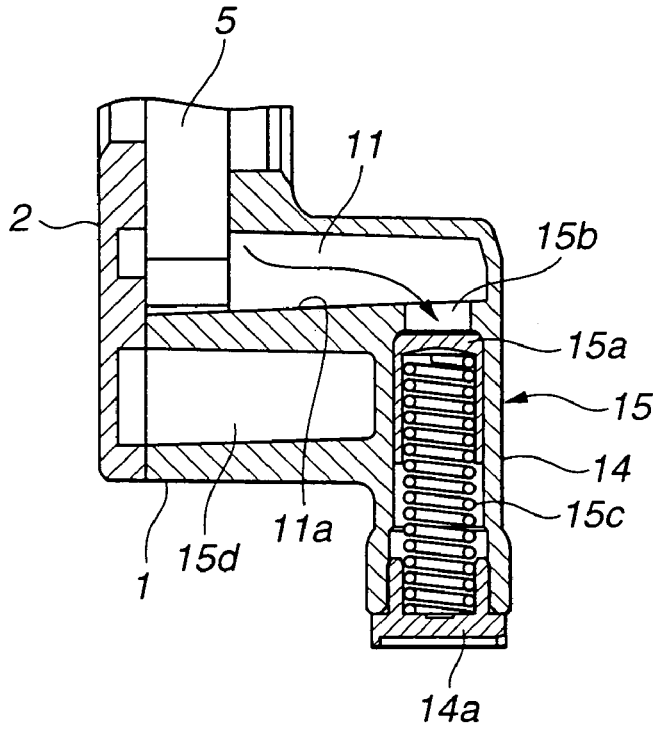
FIG. 7 is a view similar to FIG. 6 taken along the line 7-7 in FIG. 5.

Referring to FIG. 7, relief valve 15 comprises valve body 14 having a lower-end opening closed by a plug 14*a*, a lidded cylindrical valve element 15*a* axially slidably accommodated in valve body 14, a valve spring 15*c* for biasing valve element 15*a* in the direction of closing a relief hole 15*b* which provides fluid communication between bend 11 and valve body 14. When the oil pressure within outlet port 9 exceeds a predetermined value, valve element 15*a* moves backward against a basing force of valve spring 15*c* to provide fluid communication between relief hole 15*b* and a relief passage 15*d* (low-pressure side).

A partition 17 is integrally formed with the inner bottom face of outlet port 10 to protrude from outlet chamber 9 to outlet port 10.

Referring to FIGS. 1, 2, and 6-8, partition 17 is arranged roughly in the center of outlet port 10 in the cross direction to extend from outlet chamber 9 to bend 11. Partition 17 has on the side of outlet chamber 9 a distal end 17*a* disposed to face volume chamber 6 and achieving separation between the upstream and downstream sides of an outlet section of outlet chamber 9. Moreover, partition 17 serves to divide outlet port 10 into a first passage section 10*a* on the upstream side and a second passage section 10*b* on the downstream side. Therefore, the inside of bend 11 is also divided into first passage section 10*a* and second passage section 10*b*, wherein a downstream end of first passage section 10*a* which corresponds to a downstream end of bend 11 fluidly communicates with discharge passage 13, and a downstream end of second passage section 10*b* fluidly communicates with relief hole 15*b* of relief valve 15.

Partition 17 in its entirety is disposed slightly close to second passage section 10*b* so that second passage section 10*b* is smaller in cross-sectional area than first passage section 10*a*.

Figure 2:
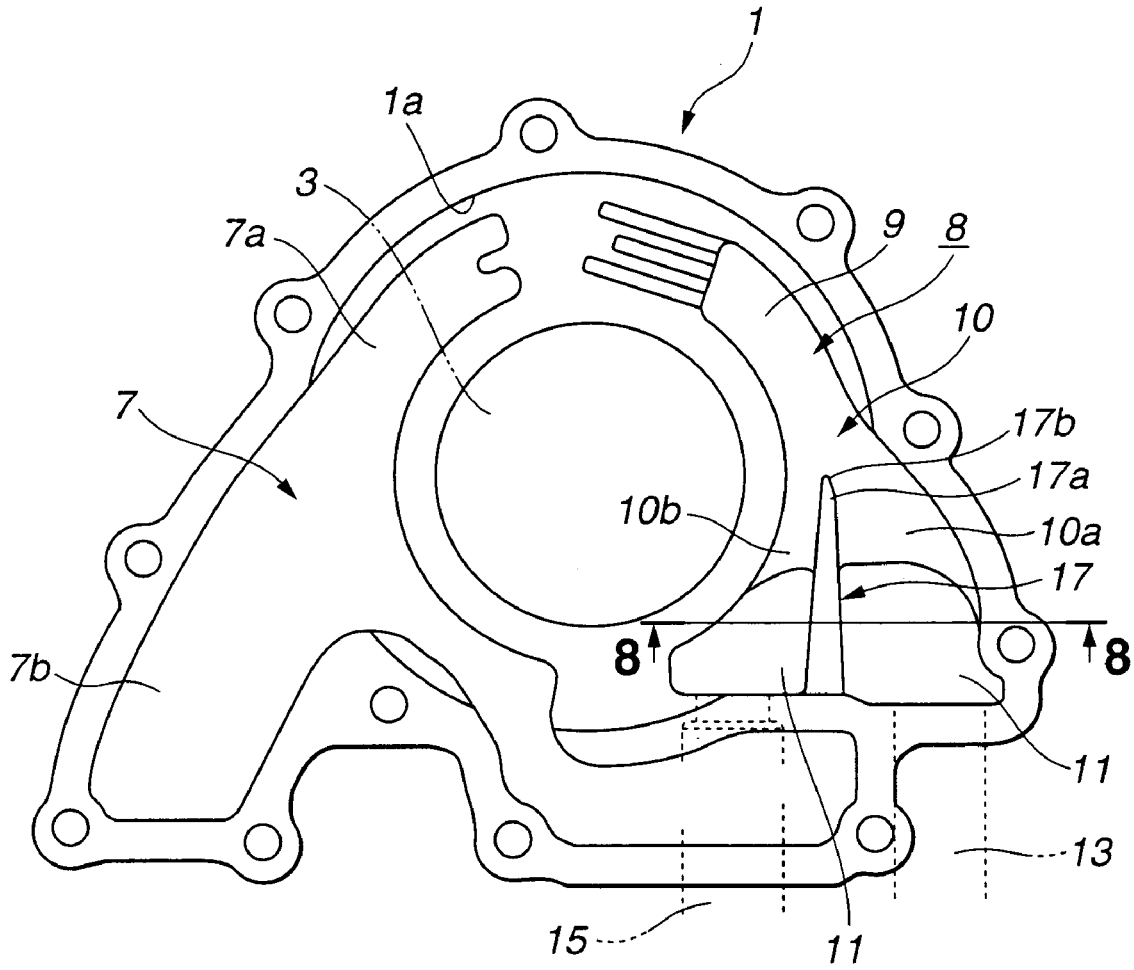
FIG. 2 is a view similar to FIG. 1, showing the inside of the oil pump.
Figure 3:
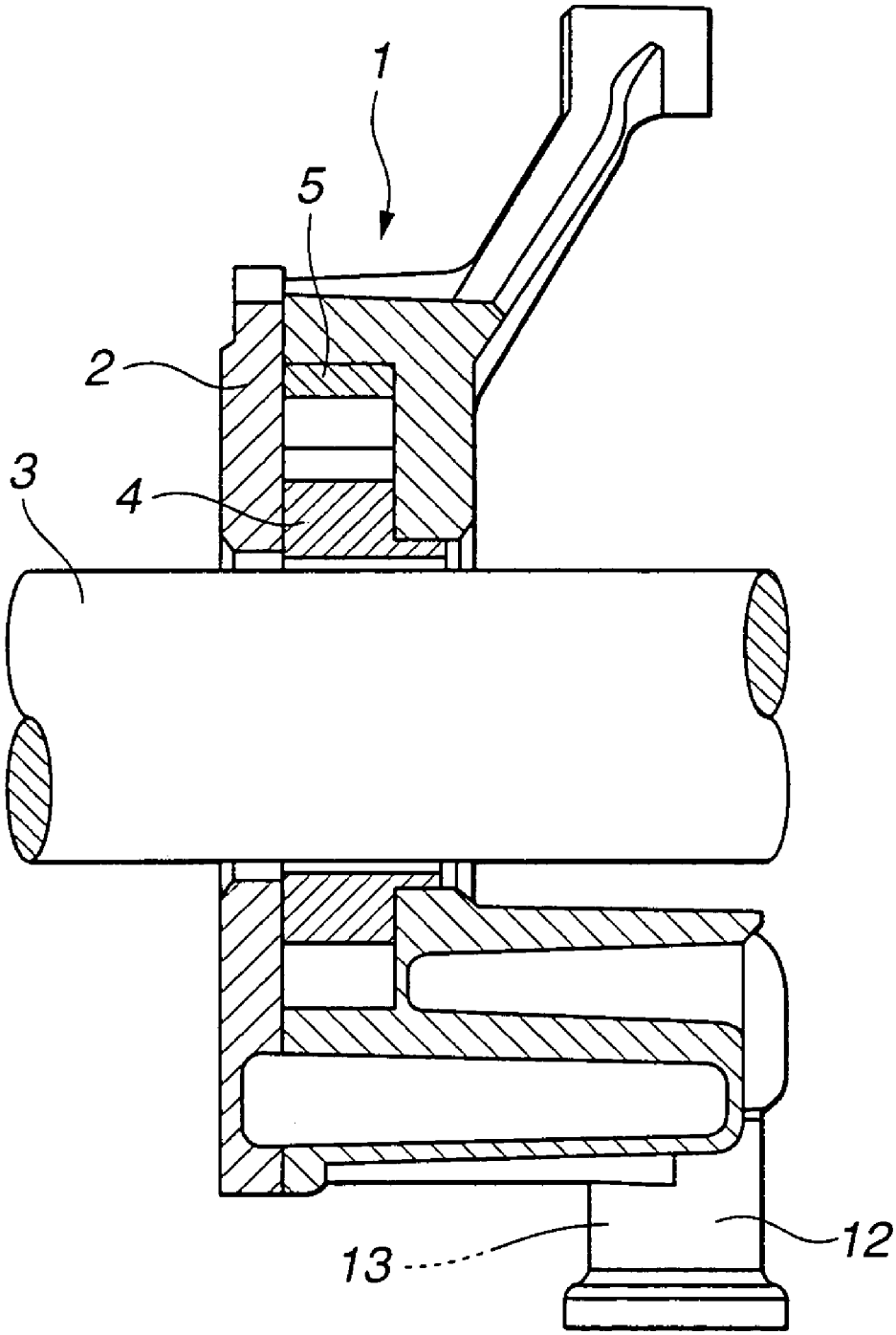
FIG. 3 is a sectional view taken along the line 3-3 in FIG. 5.
Figure 4:
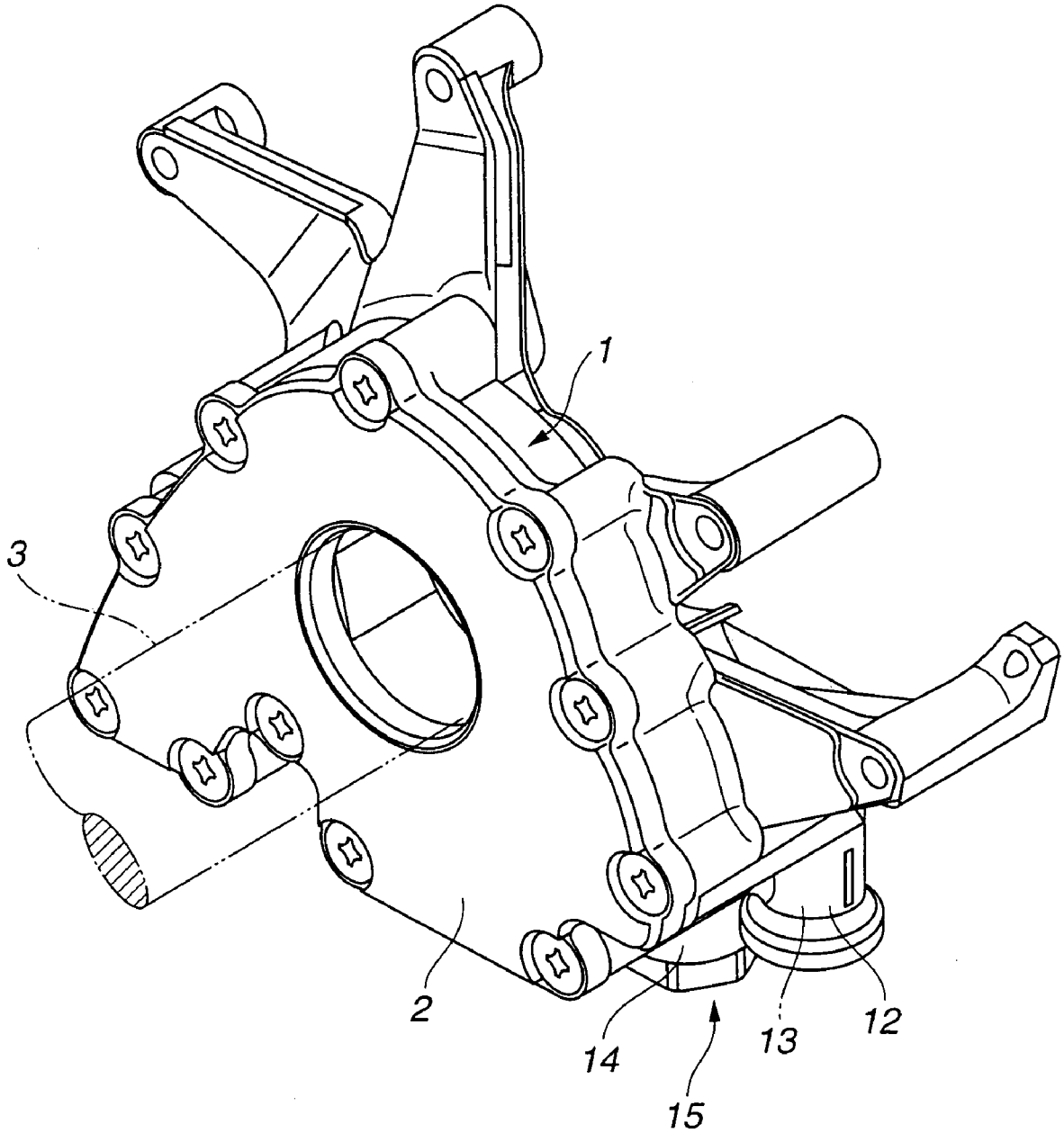
FIG. 4 is a perspective view showing the oil pump.
Figure 5:
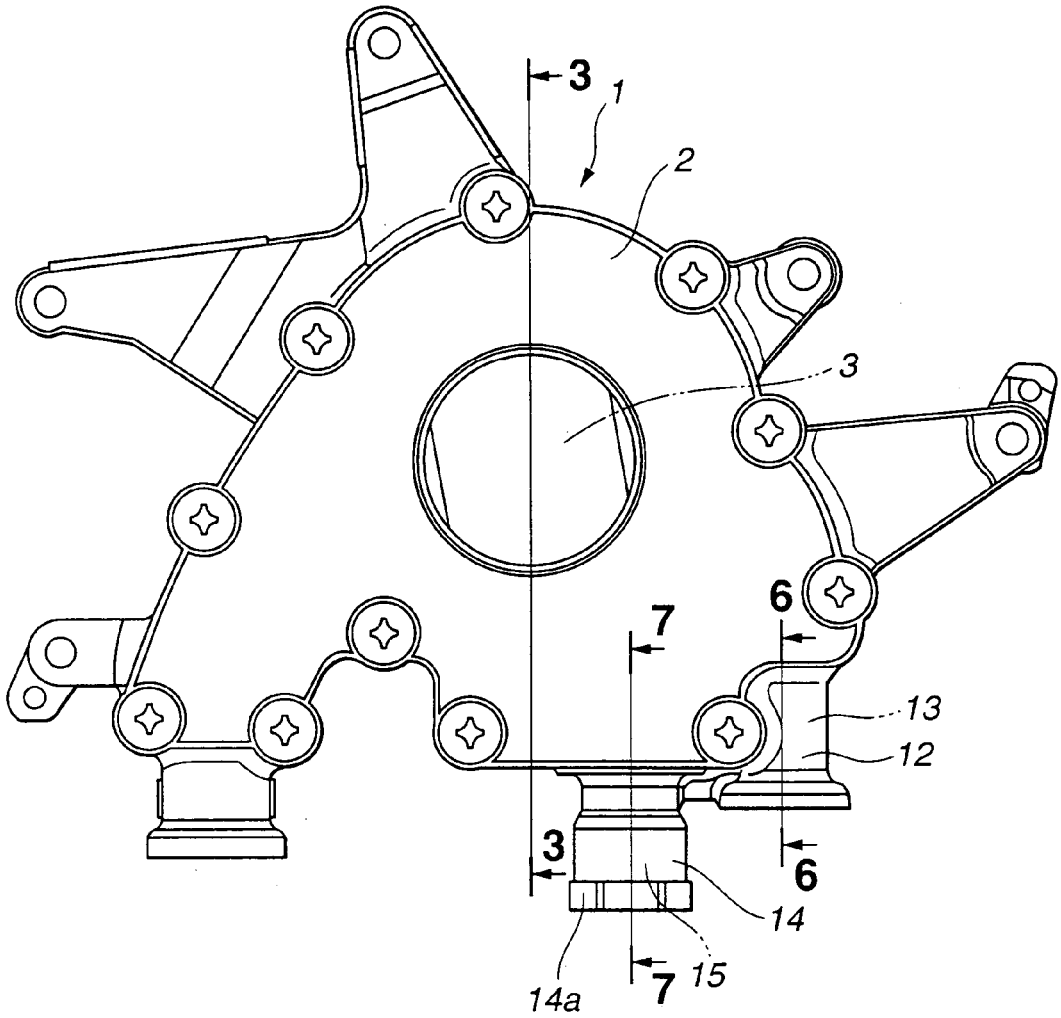
FIG. 5 is a view similar to FIG. 2, showing the oil pump.

Referring to FIGS. 1 and 2, distal end 17*a* of partition 17 is tapered down, and a side edge 17*b* on the side of first passage section 10*a* is formed roughly arcuately to conform to oil flow.

Figure 6:
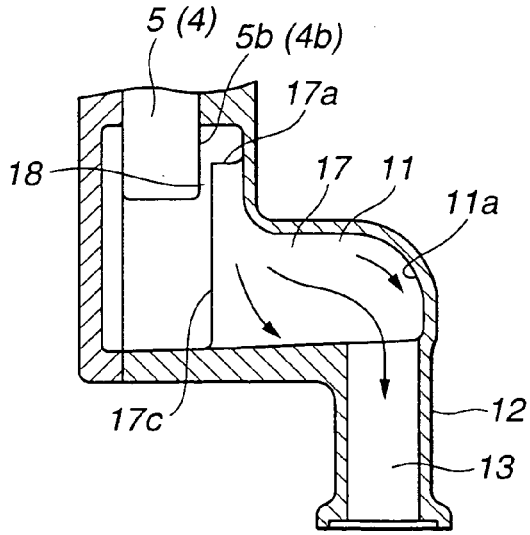
FIG. 6 is a view similar to FIG. 3, taken along the line 6-6 in FIG. 5.

Referring to FIG. 6, partition 17 has as its flat upper edge an upper end face 17*c* formed so that an edge on the side of distal end 17*a* is slightly distant from side faces 4*b*, 5*b* of rotors 4, 5. Thus, a throttle 18 is formed between the edge of upper end face 17*c* and each side face 4*b*, 5*b* to restrictively provide fluid communication between first and second passage sections 10*a*, 10*b*.

In the illustrative embodiment, therefore, the inside of outlet port 8 is separated by partition 17 into first passage section 10*a* upstream of outlet chamber 9 and second passage section 10*b* downstream thereof, allowing sufficient restraint of occurrence of a pressure variation within outlet port 8.

That is, oil having relatively great pulse pressure is discharged from first passage section 10*a* to discharge passage 13, whereas oil having relatively small pulse pressure is fed from second passage section 10*b* to relief hole 15*b* of relief valve 15. As a consequence, occurrence of pulsation in outlet port 8 can be restrained sufficiently, and, particularly, oil having smaller pulse pressure can be fed to relief valve 15, achieving effective restraint of vibration of relief valve 15 due to biasing force of valve spring 15*c* and pulse pressure. This results in possible prevention of occurrence of noise at relief valve 15.

Further, since pulsation can be reduced in outlet port 8, occurrence of noise can be also restrained in oil cooler 16 to which oil is supplied from first passage section 10*a* through discharge passage 13.

Still further, partition 17 functions as a reinforcing rib, allowing enhancement in reinforcing effect or rigidity of pump casing 1, and thereby restraint of occurrence of noise of pump casing 1 due to slight pulse pressure within outlet port 8.

Still further, oil flowing from outlet chamber 9 to first and second passage sections 10*a*, 10*b* is fed to discharge passage 3 and relief valve 15 while interfering with and being guided by a wall face 11*a* of bend 11 as shown by arrows in FIGS. 6 and 7. Since kinetic energy of oil is reduced when oil interferes with wall face 11*a* of bend 11, pulsation can be restrained more effectively together with an effect of separating outlet port 8 into first and second passage sections 10*a*, 10*b*.

Therefore, particularly, relief valve 15 is not greatly influenced by pulsation, resulting in stabilized operation and further reduced occurrence of noise.

Further, since first and second passage sections 10*a*, 10*b* are in fluid communication through throttle 18, an influence of the oil flow rate and pulse pressure on discharge passage 13 can arbitrarily be controlled by the throttling amount of throttle 18. That is, throttle 18 allows not only correct control of the flow rate of oil flowing from second passage section 10*b* to relief valve 15, but also securement of sufficient amount of oil to be supplied from discharge passage 13 to oil cooler 16.

Furthermore, since second passage section 10*b* is smaller in cross-sectional area than first passage section 10*a*, oil does not flow into relief valve 15 in large amount, but in amount restricted up to a point. This allows not only correct control of the relief amount together with a throttling effect of throttle 18 as described above, but also prevention of degradation of the lubricity with respect to various slide portions of the engine due to sufficient supply of oil from discharge passage 13 to oil cooler 16.

Further, throttle 18 allows no occurrence of slide contact between side faces 4*b*, 5*b* of rotors 4, 5 and upper end face 17*c* of partition 17, resulting in restraint of a rise in pump load due to slide frictional resistance of rotors 4, 5.

Still further, discharge passage 13 and relief valve 15 are disposed adjacent and parallel to each other, resulting in downsizing of the oil pump.

Further, distal end 17*a* of partition 17 is tapered down, allowing not only excellent separation of oil discharged to outlet port 8 into first and second passage sections 10*a*, 10*b*, but also sufficient reduction in flow resistance of oil.

Further, side edge 17*b* of distal end 17*a* of partition 17 on the side of first passage section 10*a* is formed roughly arcuately to conform with oil flow, allowing further reduction in flow resistance of oil with respect to first passage section 10*a* having greater flow rate.

Furthermore, oil cooler 16 is disposed downstream of discharge passage 13, allowing effective restraint of occurrence of pulsation which is apt to be amplified in oil cooler 16.

As described above, according to the present invention, the following effects can be obtained.

As for a primary cause of occurrence of a pulse-pressure variation (pulsation) in the outlet port, when oil flows from the area or section of the inlet port wherein the volume chamber increases in volume to the area of the outlet port wherein the volume chamber decreases in volume, the pulse pressure rises on the upstream side or the inlet-port side in the area of the outlet port due to compression of oil containing bubbles, whereas the pulse pressure lowers on the downstream side since bubbles contained in oil are crushed due to further compression of oil. Such significant variation in pulse pressure can produce pulsation. That is, pulsation varies due to pressure and volume variations of the volume chamber.

Then, according to the present invention, in view of such cause of occurrence of pulsation, the partition is arranged to separate the outlet port into the upstream section and the downstream section with respect to a position facing the volume chambers, allowing sufficient restraint of the pulse pressure acting on the relief valve. This allows effective restraint of vibration of the relief valve, minimizing amplification of pulsation, resulting in sufficient prevention of occurrence of noise. Moreover, the partition functions as a reinforcing rib, obtaining a reinforcing effect of the pump casing and the like.

Further, according to the present invention, an influence of the oil flow rate and pulse pressure on the discharge passage can arbitrarily be controlled by the throttling amount of the throttle. This allows not only correct control of the flow rate of oil flowing to the relief valve, but also securement of sufficient amount of oil flowing through the discharge passage.

Still further, according to the present invention, oil flowing from the outlet port to the first passage section is fed to the discharge passage while interfering with and being guided by a wall face of the bend. Kinetic energy of oil is reduced when oil interferes with the wall face of the bend, allowing further restraint of pulsation.

Still further, according to the present invention, the discharge passage and the relief valve are disposed adjacent and parallel to each other, resulting in downsizing of the oil pump.

Furthermore, according to the present invention, a distal end of the partition is tapered down, allowing not only excellent separation of oil discharged to the outlet port into the first and second passage sections, but also sufficient reduction in flow resistance of oil.

Further, according to the present invention, the distal end of the partition has a portion located to face the first passage section and formed substantially arcuately to conform with oil flow, allowing further reduction in flow resistance of oil with respect to the first passage section having greater flow rate.

Still further, according to the present invention, oil flowing from the outlet port to the second passage section is fed to the relief valve while interfering with and being guided by a wall face of the bend. Kinetic energy of oil is reduced when oil interferes with the wall face of the bend, allowing further restraint of pulsation. Thus, the relief valve does not greatly influenced by pulsation, resulting in stabilized operation and further reduced occurrence of noise.

Further, according to the present invention, pulsation can previously effectively reduced in the outlet port, achieving effective reduction in amplification of pulsation in the oil cooler, resulting in a great noise restraining effect. Note that pulsation produced in the outlet port is apt to be amplified in the oil cooler as an instrument disposed downstream of the discharge passage.

Having described the present invention in connection with the illustrative embodiment, it is noted that the present invention is not limited thereto, and various changes and modifications can be made without departing from the scope of the present invention. By way of example, in addition to the trochoid pump, the present invention can be applied to a vane pump or a gear pump on condition that it includes a plurality of volume chambers. Further, instead of being linear, partition 17 may be curved along the direction of passage of outlet port 8. Furthermore, instead of being tapered down in the longitudinal direction, partition 17 may be of roughly the same width in the longitudinal direction.

Figure 8:
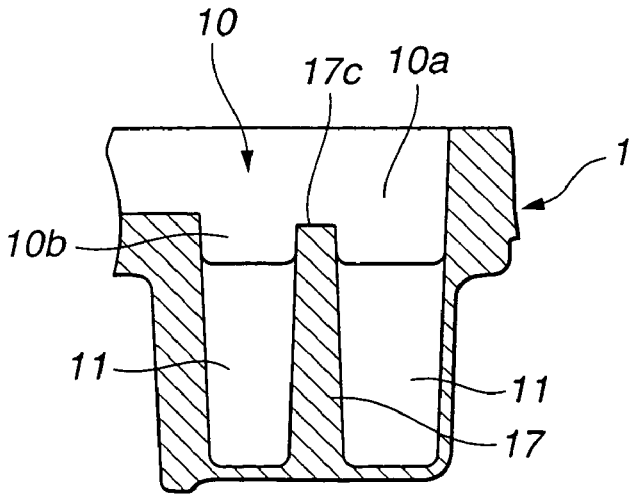
FIG. 8 is a view similar to FIG. 7 taken along the line 8-8 in FIG. 2.

Still further, as being formed together with pump casing 1 when molding pump casing 1, partition 17 is preferably tapered down in the direction of separation from the mold, i.e. from a base end to upper end face 17*c* as shown in FIG. 8. Moreover, since partition 17 can face in any direction if the position of distal end 17*a* is not changed, relief valve 15 and discharge passage 13 can be disposed parallel to each other.

The entire teachings of Japanese Patent Application P2003-374151 filed Nov. 4, 2003 are hereby incorporated by reference.

What is claimed is:

1. An oil pump, comprising:

a plurality of volume chambers each having a volume varied to inhale and discharge oil;

inlet and outlet ports, the inlet port being arranged to open over the volume chambers each having an increasing volume, the outlet port being arranged to open over the volume chambers each having a decreasing volume;

a relief valve which operates when a pressure of oil discharged to the outlet port exceeds a predetermined value, relieving part of oil in the outlet port;

a partition which divides the outlet port into upstream and downstream sections; and a discharge passage which fluidly communicates with the upstream section of the outlet port, the relief valve being disposed in the downstream section of the outlet ports wherein the partition is formed along a flow direction of oil discharged from the outlet port, wherein the discharge passage and the relief valve are disposed adjacent to and parallel to each other with respect to the partition.

2. The oil pump as claimed in claim 1, further comprising a throttle arranged between the upstream and downstream sections of the outlet port, the throttle having a cross-sectional area smaller than that of the upstream section.

3. The oil pump as claimed in claim 1, wherein the upstream section of the outlet port at a downstream end is formed curvedly to obtain a bend, wherein the discharge passage is disposed in the bend.

4. The oil pump as claimed in claim 1, wherein the partition has an upstream end tapered in a longitudinal direction of the partition.

5. The oil pump as claimed in claim 4, wherein the partition is integrated with a casing of the oil pump, wherein the partition is obtained when molding the casing.

6. The oil pump as claimed in claim 4, wherein the upstream end of the partition has a portion located to face the upstream section of the outlet port, the portion being formed substantially arcuately to conform to oil flow.

7. The oil pump as claimed in claim 1, wherein the downstream section of the outlet port at a downstream end is formed curvedly to obtain a bend, wherein the relief valve is disposed in the bend.

8. The oil pump as claimed in claim 1, wherein the discharge passage includes a downstream end arranged to be connected with an oil cooler.

9. A trochoid oil pump, comprising:

a casing having inlet and outlet ports;

inner and outer rotors arranged in the casing, the inner and outer rotors comprising external and internal teeth meshed with each other, the internal and external teeth cooperating to define volume chambers therebetween, each volume chamber varying in volume to discharge to the outlet port oil inhaled through the inlet port;

a partition which divides the outlet port into upstream and downstream sections;

a discharge passage which fluidly communicates with the upstream section of the outlet port;

a relief valve which operates when a pressure of oil discharged to the outlet port exceeds a predetermined value, relieving part of oil in the outlet port; and a throttle arranged between a side face of the outer rotor and an upper edge of the partition which faces the side face, the throttle providing fluid communication between the upstream and downstream sections of the outlet port.

10. The trochoid oil pump as claimed in claim 9, further comprising a throttle arranged between the upstream and downstream sections of the outlet port, the throttle having a cross-sectional area smaller than that of the upstream section.

11. The trochoid oil pump as claimed in claim 9, wherein the upstream section of the outlet port at a downstream end is formed curvedly to obtain a bend, wherein the discharge passage is disposed in the bend.

12. The trochoid oil pump as claimed in claim 9, wherein the partition is formed along a flow direction of oil discharged from the outlet port, wherein the discharge passage and the relief valve are disposed adjacent to and parallel to each other with respect to the partition.

13. The trochoid oil pump as claimed in claim 9, wherein the partition has an upstream end tapered in a longitudinal direction of the partition.

14. The trochoid oil pump as claimed in claim 13, wherein the partition is integrated with a casing of the oil pump, wherein the partition is obtained when molding the casing.

15. The trochoid oil pump as claimed in claim 13, wherein the upstream end of the partition has a portion located to face the upstream section of the outlet port, the portion being formed substantially arcuately to conform to oil flow.

16. The trochoid oil pump as claimed in claim 9, wherein the downstream section of the outlet port at a downstream end is formed curvedly to obtain a bend, wherein the relief valve is disposed in the bend.

17. The trochoid oil pump as claimed in claim 9, wherein the discharge passage includes a downstream end arranged to be connected with an oil cooler.

18. An oil pump, comprising:

a plurality of volume chambers each having a volume varied to inhale and discharge oil;

inlet and outlet ports, the inlet port being arranged to open over the volume chambers each having an increasing volume, the outlet port being arranged to open over the volume chambers each having a decreasing volume;

a relief valve which operates when a pressure of oil discharged to the outlet port exceeds a predetermined value, relieving part of oil in the outlet port;

partition means for dividing the outlet port into upstream and downstream sections; and a discharge passage which fluidly communicates with the upstream section of the outlet port, the relief valve being disposed in the downstream section of the outlet port, wherein the partition means is formed along a flow direction of oil discharged from the outlet port, wherein the discharge passage and the relief valve are disposed adjacent to and parallel to each other with respect to the partition means.

19. The oil pump as claimed in claim 18, wherein the oil pump comprises a trochoid pump.

* * * * *